United States Patent [19]

Knudsen

[11] Patent Number: 4,721,148

[45] Date of Patent: Jan. 26, 1988

[54] MOULDING SYSTEM FOR MAKING MOULD PARTS

[75] Inventor: Soren E. Knudsen, Lynge, Denmark

[73] Assignee: Dansk Industri Syndikat A/S, Denmark

[21] Appl. No.: 945,590

[22] Filed: Dec. 23, 1986

[30] Foreign Application Priority Data

Jan. 3, 1986 [DK] Denmark ..... 19/86

[51] Int. Cl.[4] ..... B22C 15/08

[52] U.S. Cl. ..... 164/187; 164/207

[58] Field of Search ..... 164/169, 207, 211, 187, 164/213, 180, 40

[56] References Cited

U.S. PATENT DOCUMENTS

| | | | |
|---|---|---|---|
| 3,802,486 | 4/1974 | Otaki | 164/207 X |
| 3,999,594 | 12/1976 | Gunnergaard | 164/211 X |
| 4,267,878 | 5/1981 | Mogensen et al. | 164/187 |
| 4,437,507 | 3/1984 | Seeley | 164/187 X |
| 4,442,882 | 4/1984 | Achinger et al. | 164/207 X |

FOREIGN PATENT DOCUMENTS

| | | | |
|---|---|---|---|
| 1060297A | 12/1983 | U.S.S.R. | 164/169 |

*Primary Examiner*—Nicholas P. Godici
*Assistant Examiner*—J. Reed Batten, Jr.
*Attorney, Agent, or Firm*—Larson and Taylor

[57] ABSTRACT

A moulding system for making mould parts by compacting sand or other like material between a vertical squeeze plate (12) and a vertical swingable plate (8), which form movable end walls in a squeeze chamber (6). The swingable plate is designed to swing away to allow the mould part to pass from the squeeze chamber (6) by advancing the squeeze plate (12) additionally after complete compaction. The swingable plate (8) is journalled in a foremost yoke (4), which connects with a pull yoke (2), placed behind squeeze chamber (6), by means of a rigid frame structure parallel with the longitudinal axis of the chamber.

6 Claims, 2 Drawing Figures

MOULDING SYSTEM FOR MAKING MOULD PARTS

Figure 1:
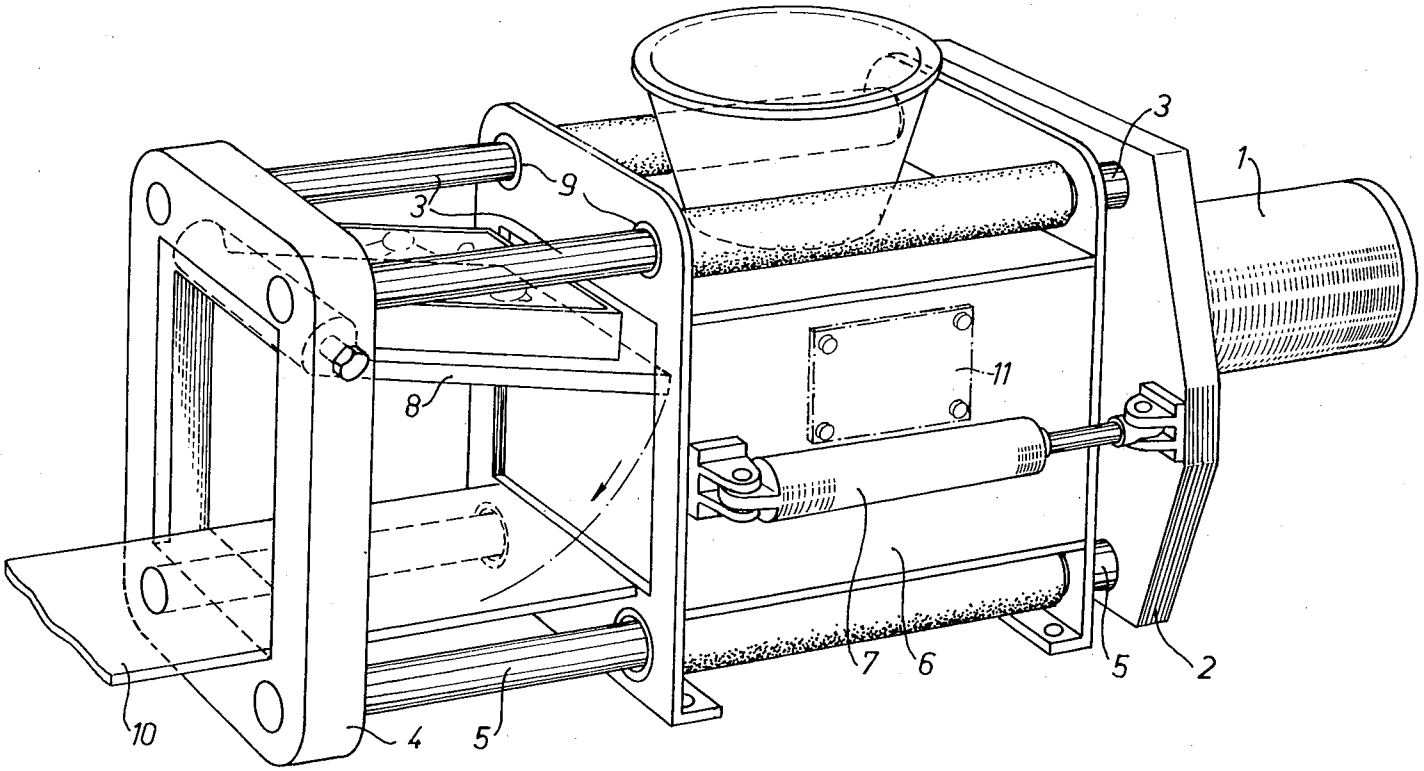

The invention relates to a moulding system for making mould parts by compacting sand or other like material between a vertical squeeze plate and a vertical swingable plate, forming movable end walls in the squeeze chamber, and where the swingable plate swings away after compaction to allow mould part passage from the squeeze chamber by further advance of the squeeze plate.

In systems of this nature, cylinder piston units placed behind the moulding chamber have previously been used for both the squeeze plate and the foremost yoke, as the latter has been connected with the rearmost cylinder piston unit via columns and a pull yoke or a so-called traversing unit.

Due to the long columnar guides, the said conventional systems are comparatively complex and require much space, which means that they are uneconomical.

The object of the invention is to provide a system for making mould parts, where the swingable plate is controlled accurately in spite of the "uneven" tensions applied to the squeeze plate and the swingable plate, respectively, in connection with differently shaped patterns.

According to the invention, this object is achieved by a moulding system of the type described in the opening paragraph, characterized in that the swingable plate is journalled in a front yoke, which connects with a pull yoke placed behind the squeeze chamber by means of a rigid frame structure parallel with the longitudinal axis of the chamber.

This results in a rigid structure, as the foremost and the rearmost yokes may connect rigidly with the comparatively short columnar-like elements and are thus more suited to absorb bending influences as well as torsional moments around the longitudinal axis of the squeeze chamber. The distance between the foremost and rearmost yokes, which determines the columnar length, can be minimized to the length of the squeeze chamber plus the pivotal movement of the swingable plate in the foremost yoke.

In a preferred embodiment of the system according to the invention, the foremost yoke and the pull yoke connect via four columns placed at the corners of the yokes, and the two upper columns are journalled in chamber-connected guides, while the two lower columns are free.

This ensures secure guiding of the two connected yokes by using just two column guides, and both manufacturing and mounting costs are reduced. In addition, the bottom of the squeeze chamber may be shaped integrally with the bottom frame, which is not to serve as a seat for bearings or guides for the two lower columns.

In addition, the two free columns may have a larger cross-section than the upper columns and be thicker than columns used in known machines, and in other respects have similar dimensions. In borderline cases, the lower columns may form a contiguous structural element.

According to the invention, the rearmost yoke may be moved backwards and forwards in the longitudinal direction of the squeeze chamber by means of a cylinder piston unit on either side of the squeeze chamber, which is essentially placed in the horizontal symmetrical plane of the squeeze chamber.

When the movement of the unit made up of the yokes and the columns is brought about by two symmetrically placed cylinder piston units on either side of the squeeze chamber and with the point of application on the rearmost yoke, the maximum possible symmetrical stress is ensured in the yoke that is not weakened by a central opening for a swingable plate. In this way it is possible to operate with close dimensions in the structural stress-absorbing members. In addition, cylinders are placed at an area where they do not interfere much with pattern plate replacement, such as is the case with e.g. the swingable plate in the foremost yoke.

In yet another preferred embodiment of the moulding system according to the invention, the squeeze plate is operated by a cylinder piston unit, which connects rigidly with the squeeze chamber.

This provides for a compact structure with concentrated stress application around the squeeze chamber, and the independent cylinder piston units at the foremost yoke and at the squeeze plate eliminate the danger of elastic spring-back in the hydraulic system.

According to the invention, the piston of the squeeze plate may be fixed to the bottom of a fixture pipe enclosing that portion of the movable squeeze plate cylinder which protrudes from the squeeze chamber, as the fixture pipe is secured to the rear wall of the squeeze chamber around the opening for the squeeze plate cylinder thereof.

Thus, the fixture pipe partly serves to protect the movable squeeze plate cylinder against the surroundings, and partly as a rigid power-transmitting element.

By letting the rearmost yoke, as proposed according to the invention, have an opening corresponding to the fixture pipe, it is possible to feed the rearmost yoke all the way up to the rear wall of the squeeze chamber.

Figure 2:
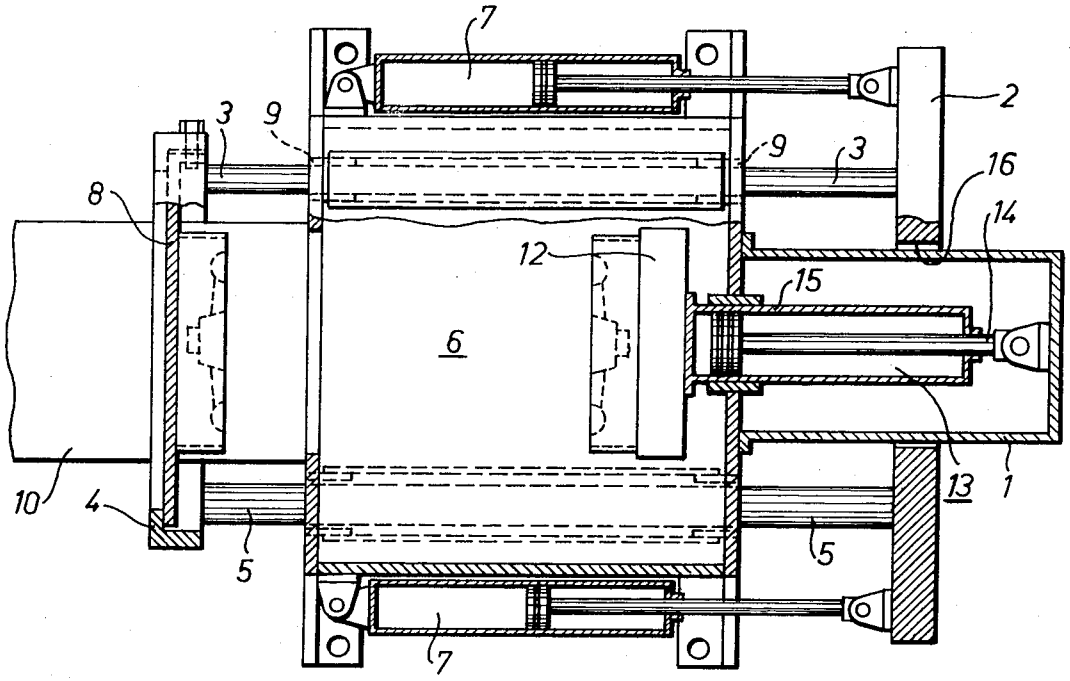

Below, the invention will be explained in detail with reference to the drawing in which FIG. 1 shows a simplified version of a system according to the invention, and FIG. 2 is a top plan view with portions cut away of the system depicted in FIG. 1.

FIG. 1 in the drawing shows schematically a rigid frame structure around a squeeze chamber 6 of a type known per se; the said structure consists of the foremost yoke 4, in which a swingable plate 8 is journalled, such plate being conventionally designed to accept a half-pattern, and a rearmost yoke 2, or a pull yoke, conecting via columns 3 and 5 with the foremost yoke 4. In the embodiment shown in the drawing, the two upper columns 3 are guided in bearings 9, firmly mounted on the squeeze chamber 6. The lower columns 5 have a substantially larger cross-section than the upper columns 3, and are without guides. The structure made up by the foremost yoke 4, the rearmost yoke 2, and the columns 3 and 5 constitute a rigid box-shaped structure, which can be moved forwards and backwards in the longitudinal direction of the squeeze chamber by means of cylinder piston units 7 placed laterally of the squeeze chamber and firmly connected therewith.

The swingable plate 8, which is journalled in the foremost yoke 4, forms the one movable end wall in the squeeze chamber 6. The other movable end wall is formed by a squeeze plate 12, which is a movable cylinder 15 in the embodiment shown in the drawing, the said cylinder supporting a half-mould at its side facing the swingable plate. The half-mould of the squeeze plate is placed through the opening 11 in the side of the squeeze chamber, shown schematically in FIG. 1.

The movable cylinder, which serves as squeeze plate 12, is moved by a piston 14, fixed at the bottom of a fixture pipe 1, which protrudes from the rear of the squeeze chamber and connects with it along an opening in the rear wall of the squeeze chamber. An opening 16 corresponding to the cross-section of the fixture pipe is provided in the rearmost yoke 2.

After being squeezed in the squeeze chamber 16, the mould parts made are shot onto a conveyor belt 10 by additionally advancing the squeeze plate 12 and swinging up the swingable plate 8.

The operation of the system is indicated in FIG. 2 by the explanatory diagram. After the mould halves have been placed on the swingable plate 8 and the squeeze plate 12, respectively, the squeeze chamber is closed by the return of the rearmost yoke 2 by means of the cylinder piston units 7 placed on the side of the squeeze chamber and the first stepwise forward movement of the squeeze plate 12. Sandshot and squeezing known per se are then made by compacting the swingable plate 8 and the squeeze plate 12 by actuation of the cylinder piston units 7 on the side of the squeeze chamber and the cylinder piston unit 15 at the rear wall of the squeeze chamber and inside the fixture pipe 1. After completion of the squeezing operation, the mould part is shot out of the mould chamber in the way described above.

I claim:

1. A moulding system for making mould parts by compacting sand or other like material between a vertical squeeze plate (12) and a vertical swingable plate (8), forming movable end walls of a squeeze chamber (6), and where the swingable plate (8) swings away after compaction to allow mould part passage from the squeeze chamber by further advance movement of the squeeze plate (12), characterized in that the swingable plate (8) is journalled in a foremost yoke (4), which connects with a pull yoke (2) placed behind the squeeze chamber by means of a rigid frame structure parallel with the longitudinal axis of the chamber.

2. A moulding system according to claim 1, characterized in that the frame structure consists of two upper columns and two lower columns (3,5) placed at respective corners of the yokes (4,2), and that the two upper columns (3) are journalled in chamber-connected guides (9), while the two lower columns (5) are free.

3. A moulding system according to claim 1, characterized in that the pull yoke (2) is moved backwards and forwards in the longitudinal direction of the squeeze chamber (6) by means of a cylinder piston unit (7) on each side of the squeeze chamber (6) and essentially placed in the horizontal symmetrical plane of the squeeze chamber (6).

4. A moulding system according to claim 1, characterized in that the pull yoke (2) has an opening (16) corresponding to the fixture pipe (1).

5. A moulding system according to claim 1, characterized in that the squeeze plate (12) is operated by a cylinder piston unit (13) which is rigidly connected with the squeeze chamber (6).

6. A moulding system according to claim 4, characterized in that the piston (14) of the cylinder piston unit of the squeeze plate is fixed to the bottom of a fixture pipe (1), enclosing that portion of the squeeze plate cylinder (15) which protrudes from the squeeze chamber (6), said fixture pipe (1) being fixed to a rear wall of the squeeze chamber (6) around the opening for the squeeze plate cylinder therein.

* * * * *